US006004158A

United States Patent [19]

Ward

[11] Patent Number: 6,004,158

[45] Date of Patent: Dec. 21, 1999

[54] ELECTRICAL CONNECTOR WITH SECONDARY LOCKING PLATES

[75] Inventor: Bobby Gene Ward, King, N.C.

[73] Assignee: The Whitaker Corporation, Wilmington, Del.

[21] Appl. No.: 08/825,280

[22] Filed: Mar. 27, 1997

[51] Int. Cl.[6] ..... H01R 13/40

[52] U.S. Cl. ..... 439/595; 439/752

[58] Field of Search ..... 439/752, 595, 439/357, 358, 361, 362, 364, 701

[56] References Cited

U.S. PATENT DOCUMENTS

| | | | |
|---|---|---|---|
| 4,973,268 | 11/1990 | Smith et al. | 439/595 |
| 5,299,959 | 4/1994 | Yamamoto et al. | 439/752 |
| 5,554,055 | 9/1996 | Miller | 439/752 |
| 5,830,013 | 11/1998 | Saito et al. | 439/595 |
| 5,839,923 | 11/1998 | Yoshida | 439/752 |
| 5,848,919 | 12/1998 | Nagano | 439/752 |

OTHER PUBLICATIONS

European Patent Abstract for patent No. 511649 filed Apr. 29, 1992.

Japanese Patent Abstract for patent No. 8227750 filed Feb. 22, 1995.

*Primary Examiner*—Khiem Nguyen

*Assistant Examiner*—Michael C. Zarroli

*Attorney, Agent, or Firm*—Robert W. Pitts

[57] ABSTRACT

An electrical connector 2, especially intended for automotive applications includes a receptacle connector housing 4 and a mating plug connector housing 6. A movable alignment plate 10 is located between the two connector housings and locking plates 12 are insertable into each housing to provide for additional retention of terminals 100 also held in terminal cavities 34 by resilient latches 50. The connector 2 also includes a cover 8 that is attached to the receptacle connector housing 4 by molded cantilever cover latches 20. Backup beams 28 are movable into engagement with the cover latches 20 for support. Each locking plate 12 is insertable into a locking plate slot 30 on the end of one of the housings and includes recesses 70 into which the molded resilient terminal latches 50, which span the locking plate slot 38, are received when the locking plate 12 is fully inserted. Locking tabs 72, 74, 76, engage the terminals 100 beside the resilient latches 50 provide additional retention of the terminals 100.

8 Claims, 8 Drawing Sheets

ELECTRICAL CONNECTOR WITH SECONDARY LOCKING PLATES

BACKGROUND OF THE INVENTION

1. Field of the Invention

This invention is related to electrical connectors and especially to electrical connectors used to connect a plurality of wires, such as wires in an automotive harness or harnesses. This invention is more particularly related to the use of secondary or auxiliary locking members to prevent terminals from being dislodged from molded connector housings and to prevent disengagement of mating terminals.

2. Description of the Prior Art

Although it is important for electrical connectors in all applications to establish a reliable electrical termination that will not be disengaged under normal operating conditions, automotive applications tend to have more problems with failed terminations than many other applications. The failure of electrical connectors in automotive applications is not only due to the environment in which the connectors are used, but many problems have been traced to errors in assembling the electrical connectors and the harness in which they are employed. With the increased use of electronics in automotive applications these problems can be compounded simply because of the additional circuits and wires that must be joined by electrical connectors.

To overcome these problems, electrical connectors used in automotive applications have used secondary or redundant locking to prevent terminals from being disengaged from the molded housings in which multiple terminals are mounted. Terminal position assurance, which means that the electrical connector assemblies cannot be assembled if terminals are improperly positioned, has been used, and in many prior art connectors, secondary or redundant locks cannot be assembled unless the terminals are properly seated in the housings.

One inherent problem with secondary or redundant locking schemes is that they inevitably take up space. With the increasing number of wires and circuits that must be connected, space often becomes critical. Many connectors have a large number of terminals densely packed in a small space. It is also common to house terminals of different size in the same connector. For example, terminals for supplying electrical power to components in an automobile are commonly housed in the same connector with a large number of terminals connecting signal wires. Each terminal in connectors of this type must be held in position by a molded resilient latch engaging the terminal in its terminal cavity and a secondary or redundant locking member is used either to ensure that the resilient latch does not become disengaged or to independently hold the terminals in the connector. When other common problems, such as the tendency of mating terminals to stub during mating, the tendency of terminals and connector covers to become disengaged when the wires are jerked, and the need to insure that connectors can be assembled and mated in only one orientation must be solved by connector design, it becomes difficult to meet all of these requirements within a given space.

SUMMARY OF THE INVENTION

The electrical connector that is the preferred embodiment of this invention includes a number of features in one electrical connector design that is especially adapted for use in automotive and similar applications. This electrical connector is especially adapted for use as a cowl connector in an automobile. This connector includes a number of terminals and both power and signal terminals are combined in plug and receptacle connector housings. Each terminal is held in its terminal cavity by a resilient latch that comprises a molded extension of the housing. Redundant or secondary latching is provided by locking plates that are insertable into the connector housings laterally of the terminals cavities with which locking plate slots communicate. Terminals can be loaded into appropriate terminal cavities when the locking plates are in a partially inserted position because the locking plates include aligned openings though which the terminals can be inserted. Locking tabs on the locking plates engage each of the terminals when the locking plate is fully inserted. The connector also includes an alignment plate that is normally positioned between plug and receptacle connectors that guides the tabs of terminals into mating socket terminals in the other connector without stubbing as blade terminals initially enter into mating socket terminals. A cover is also provided on the exterior face of the receptacle connector through which the wires exit the connector. This entire connector assembly is held together and mating force is supplied by a bolt subassembly connecting the two connector housings.

In addition to each of these features, this connector also provides support for latches joining the connector cover to the receptacle connector housing without increasing the cross section area or the volume of the connector. Backup beams are provided on the movable alignment plate located between the two connector housings. These backing beams extend through the housing and are positioned behind resilient cover latches when the connector assembly is completed. The backing beams insure that the cover latches are in engagement with shoulders on the receptacle connector housing. In the preferred embodiment of this invention, these backing beams are extensions of snap latch beams that extend from the alignment plate toward the plug connector housing. These snap latch beams are initially held in place on the receptacle housing by protrusions or bumps on the receptacle connector. Diamond shaped projections on the plug connector housing eventually disengage the snap latches from the receptacle connector. This action ensures that the alignment plate remains in engagement with the terminal blades as the blades enter the mating terminal sockets during initial mating. It also ensures that the backing beams will not engage the cover latches during assembly of the cover to the receptacle connector housing or until the latter stages of relative movement between the plug and receptacle connectors during mating.

The locking plates also engage the terminals beside the molded cantilever housing latches to save space. The width of these molded cantilever latches is less than the width of a recess or slot in the locking plate so that the latches fit within the locking plate recess. The cantilever latches extend from the top of the locking plate slot to a position slightly below the locking plate slot where they engage the terminals. Locking tabs on opposite sides of the locking plate recess engage terminal tabbs that are located on either side of the terminal opening in which the molded resilient latch fits to establish primary retention of the terminals in the housing.

DETAILED DESCRIPTION OF THE PREFERRED EMBODIMENT

Figure 1:
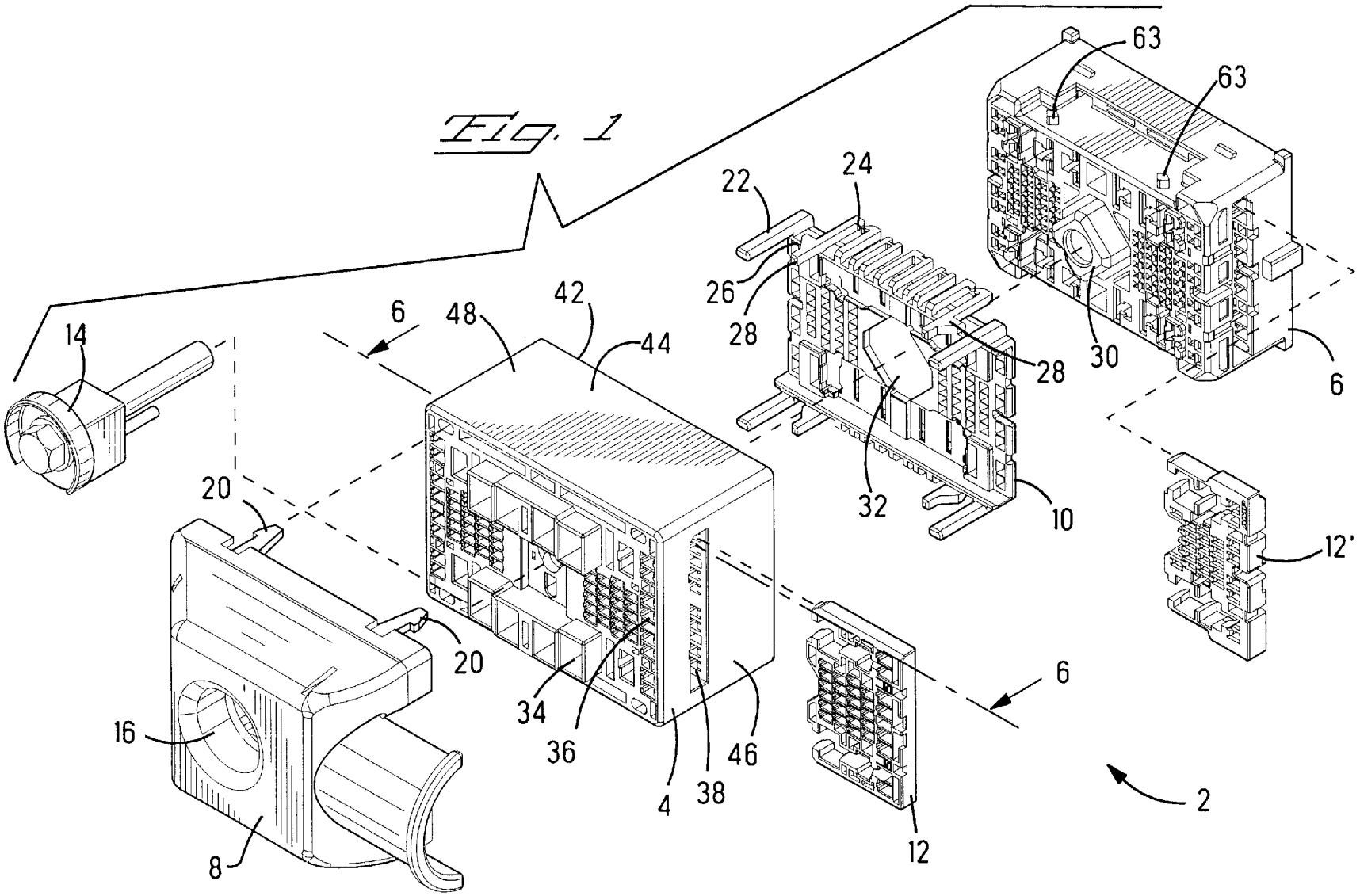
FIG. 1 is an exploded perspective view of the cowl connector showing the two main halves of the connector housing and the terminal positioning and locking members, and the connector cover.

The housing components of cowl connector 2 are shown in FIG. 1. This connector is primarily intended for use in automotive applications. Cowl connector 2 includes two main housing halves, a receptacle connector housing 4 and a plug connector housing 6. The connector 2 also includes a connector cover 8 that can be attached to an exterior surface of the receptacle connector housing 4. A movable terminal alignment plate 10 is located between the receptacle connector housing 4 and the plug connector housing 6. The conventional purpose of the movable plate 10 is to align tabs on terminals, not shown in FIG. 1, during mating to prevent stubbing. Similar terminal locking plates 12 and 12' can be inserted into the opposite ends of both the receptacle connector housing 4 and the plug connector housing 6 to lock the terminals in each connector half in place. A bolt subassembly 14 secures the connector assembly 2 in place and permits sufficient force to be applied to mate the large number of mating terminals contained in this connector. Threads on the bolt assembly 14 engage companion threads on an insert nut mounted in the tower 30 on the plug connector housing 6. In the preferred embodiment, the receptacle housing 4 and the plug housing 6 are molded from a conventional thermoplastic, such as PBT. The connector cover is also molded from a conventional thermoplastic, such as polypropylene. The movable alignment plate 10 and the terminal locking plates 12 are also molded from a conventional thermoplastic, such as PBT, and preferably have a distinct color so that it is easy to determine if they are in their correct positions.

Conventional stamped and formed terminals, such as terminals 100 would typically be used in this connector 2. These terminals would be attached to insulated wires. Larger terminals 100, suitable for carrying currents transmitting relatively larger electrical power, and attached to 10–12 AWG wires are inserted into terminal cavities 34 in the receptacle connector housing 4 and similar corresponding cavities in the plug connector housing 6. These terminal cavities 34 are located along opposite sides of both connector housings. Other terminals suited to carry signal currents can be mounted in terminal cavities 36 that are located between the larger terminal cavities 34 and along the ends of the connector housings.

Figure 6:
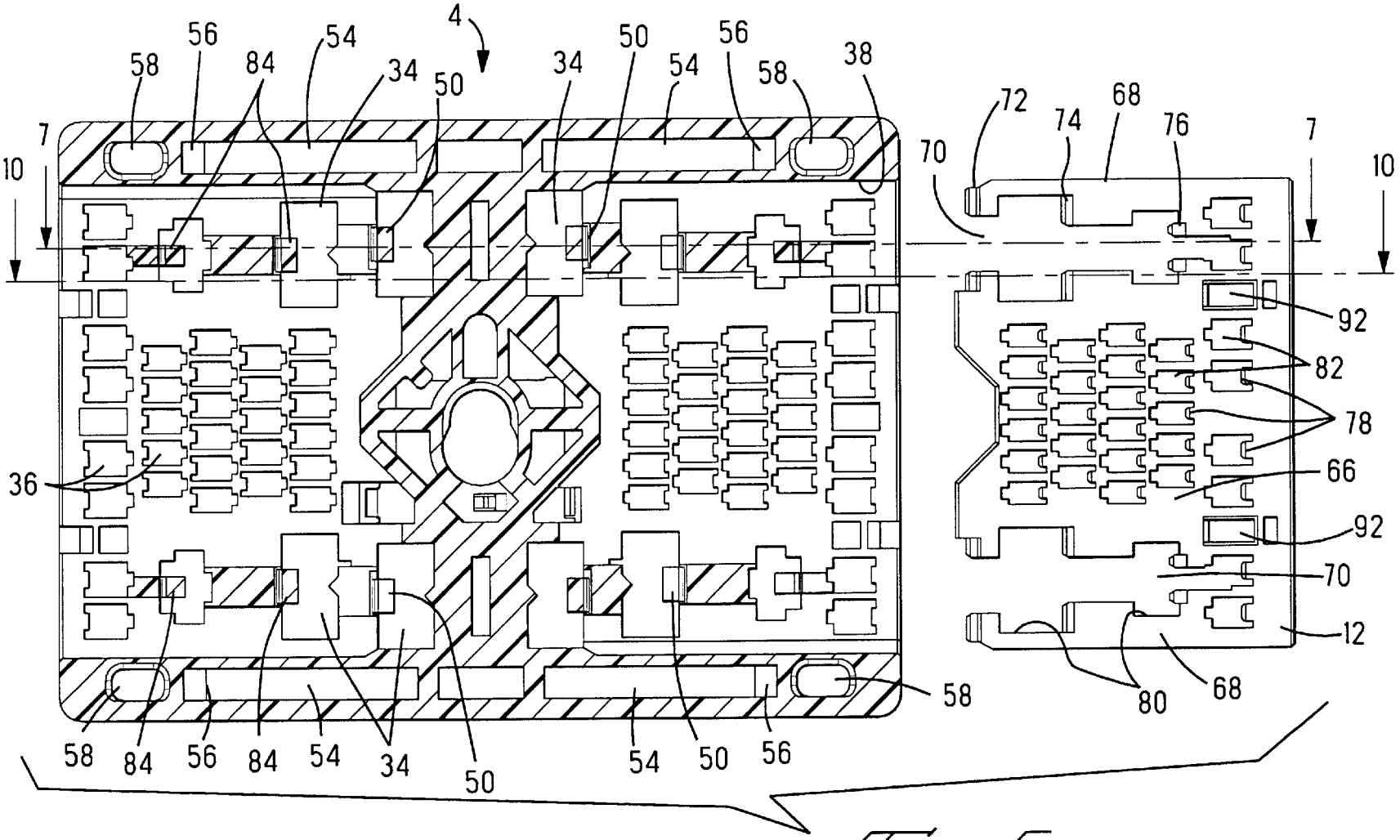
FIG. 6 is a section view looking from below and taken along section lines 6—6 in FIG. 1 showing a terminal locking plate exploded from one side of receptacle connector housing.

Prior to inserting terminals attached to wires into the two connector housings, the locking plates 12 and 12' are first partially inserted into the locking plate slots 38 on opposite ends of both connector housings. As shown in FIG. 6, each locking plate includes openings 80, 82 and slots 70 that can be aligned with corresponding terminal cavities 34 and 36 when the locking plates are partially inserted into the corresponding locking plate slots 38. With the locking plates in this partially inserted position, terminals can be inserted into the terminal cavities 34, 36 and through the aligned openings 80, 82 and slots 70. Signal terminals can similarly be inserted into terminal receiving cavities 36 with the locking plates in the partially inserted position.

Figure 2:
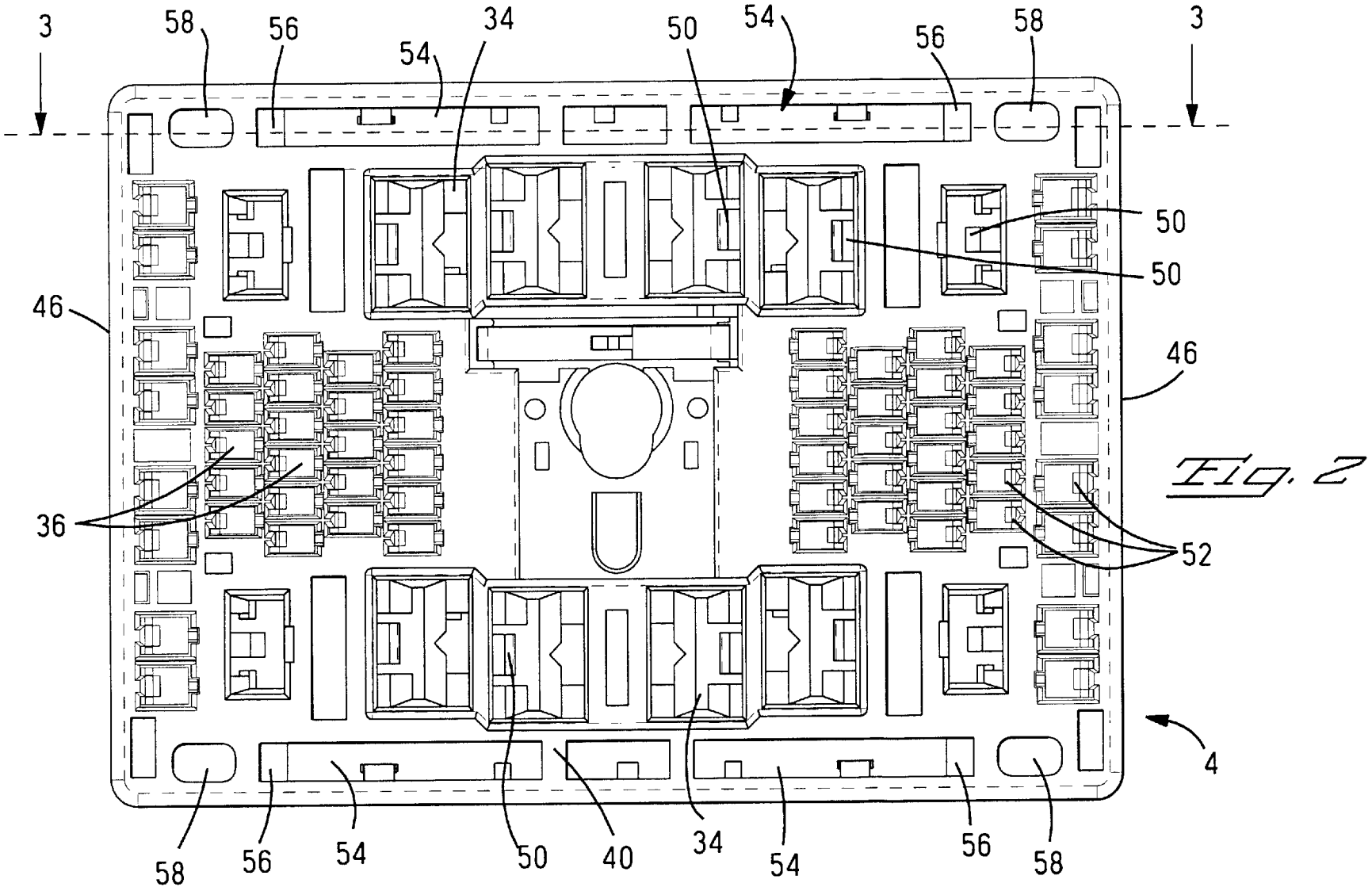
FIG. 2 is a view of the exterior surface of the receptacle connector housing showing the terminal cavities extending through the body of this housing member.
Figure 3:
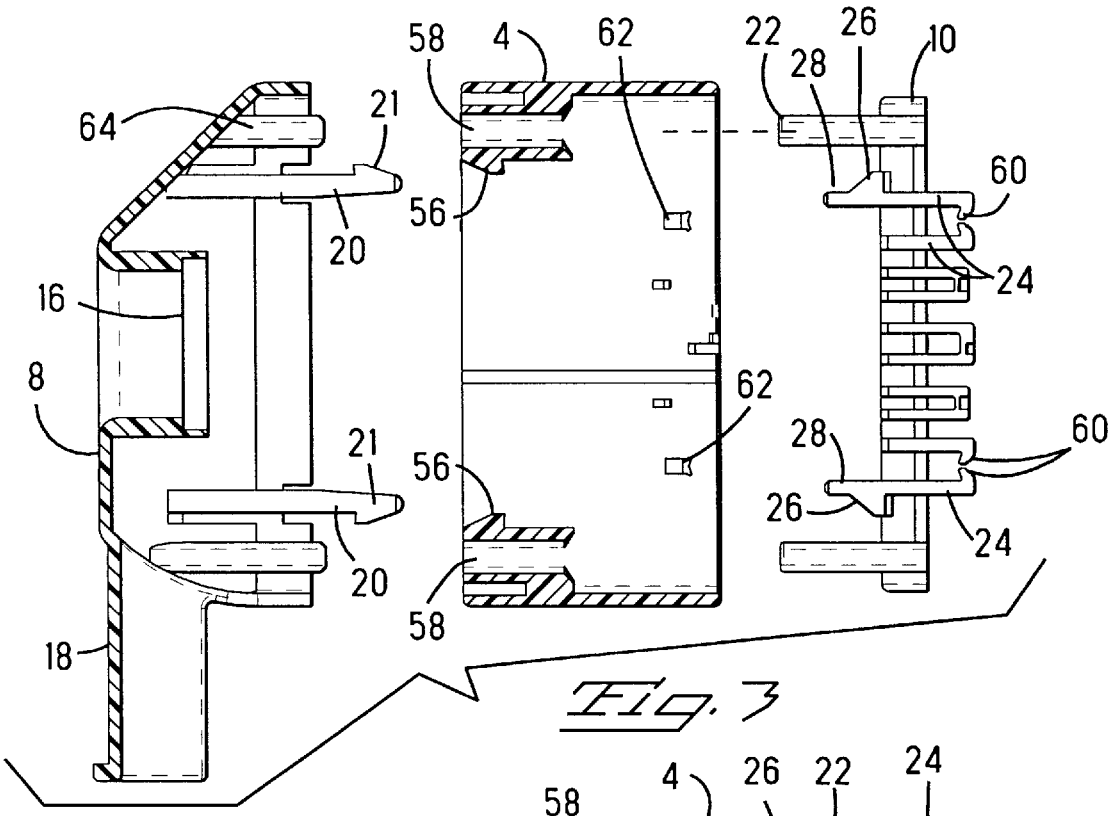
FIG. 3 is a section view taken from the orientation of section lines 3—3 in FIG. 2, but also showing the orientation of the connector cover and a movable terminal alignment plate.
Figures 7, 8, 15:
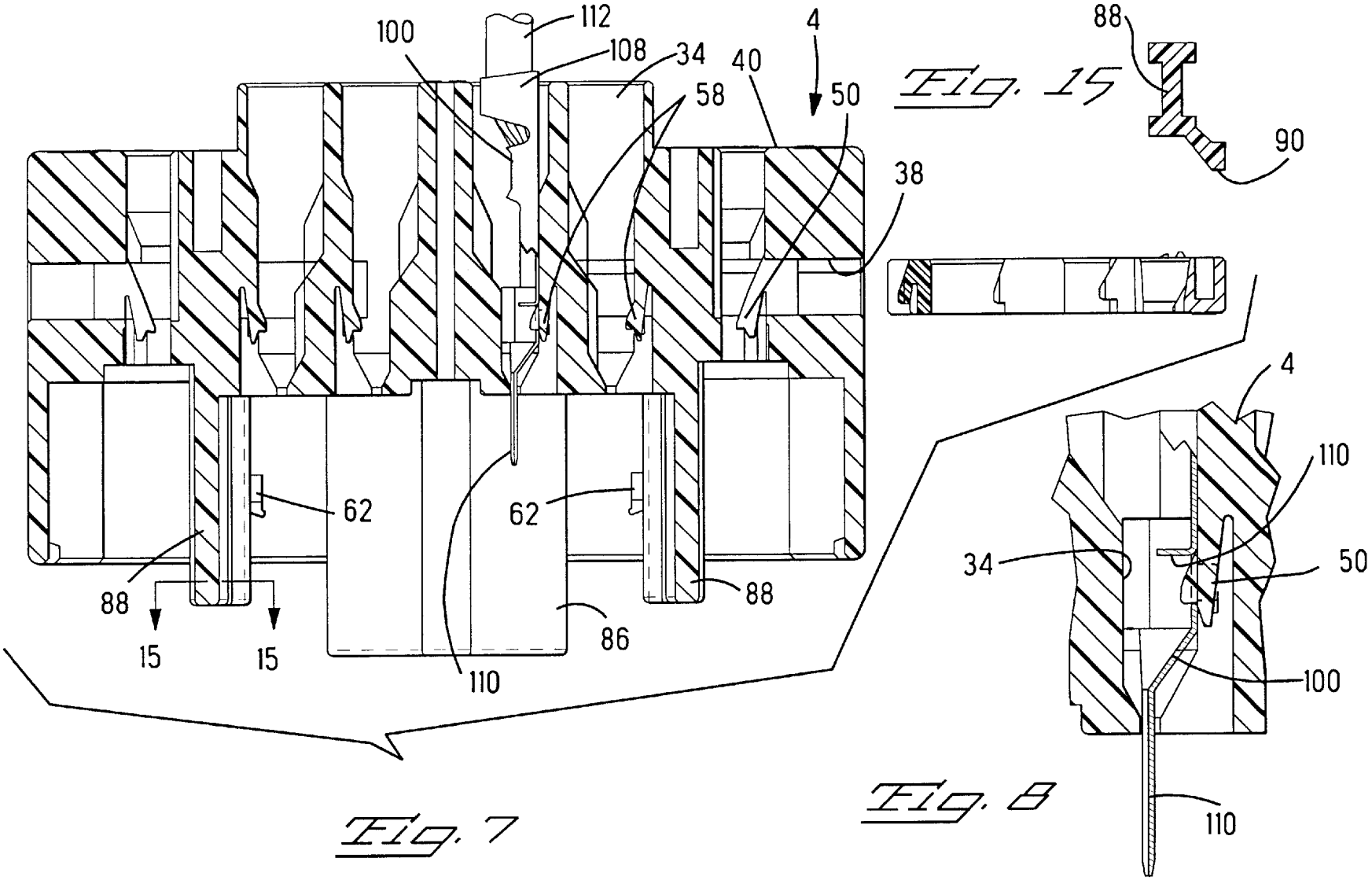
FIG. 7 is a view taken along section lines 7—7 in FIG. 6 showing the exploded terminal locking plate and a terminal positioned in one cavity of the receptacle housing.
FIG. 8 is an enlarged view of the terminal shown in FIG. 7.
FIG. 15 is a section view of a terminal alignment post taken along the section lines 15—15 shown in FIG. 7.
Figure 9:
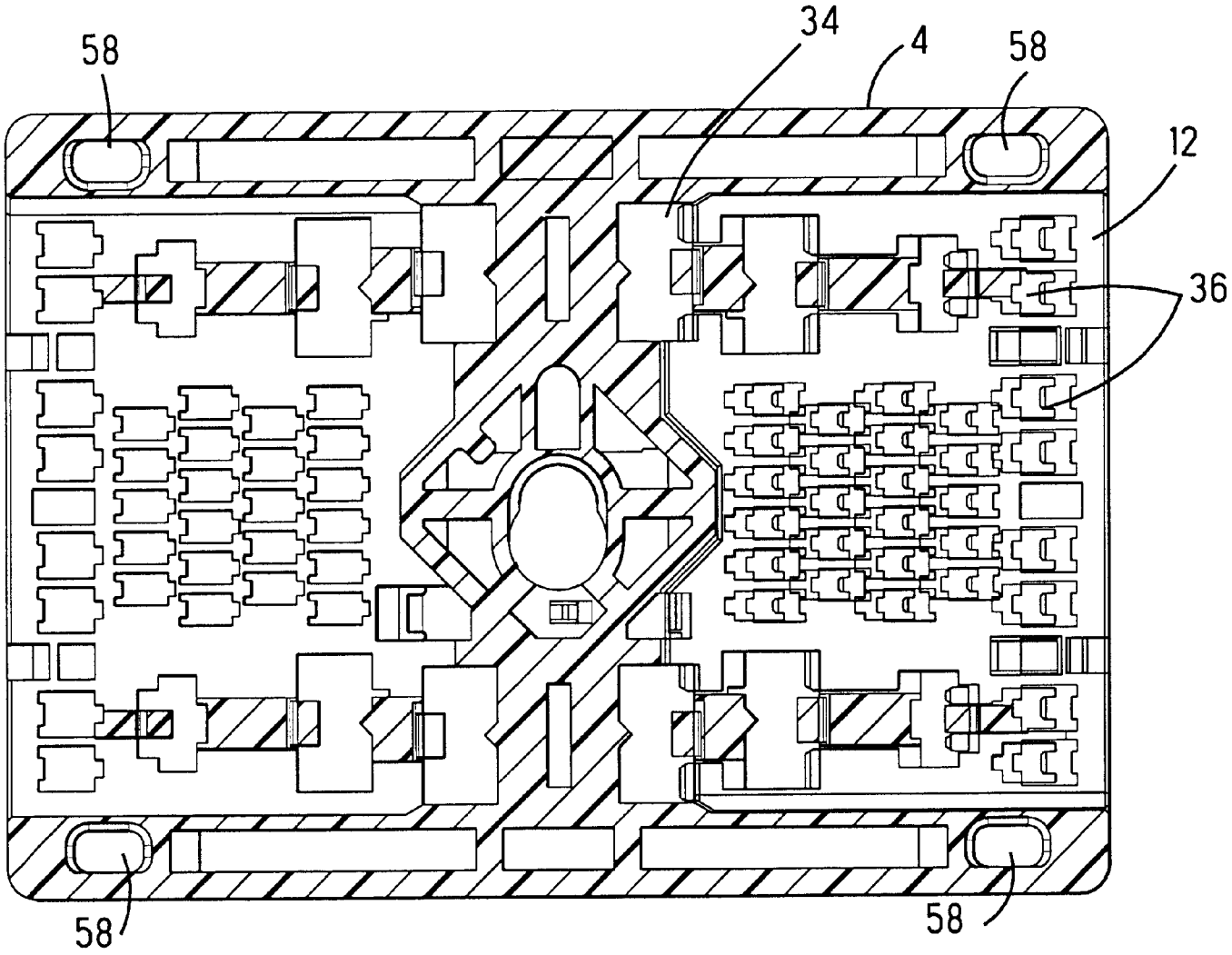
FIG. 9 is a view taken from the same orientation as FIG. 6 showing one terminal locking plate fully inserted into the receptacle housing.
Figures 10, 11:
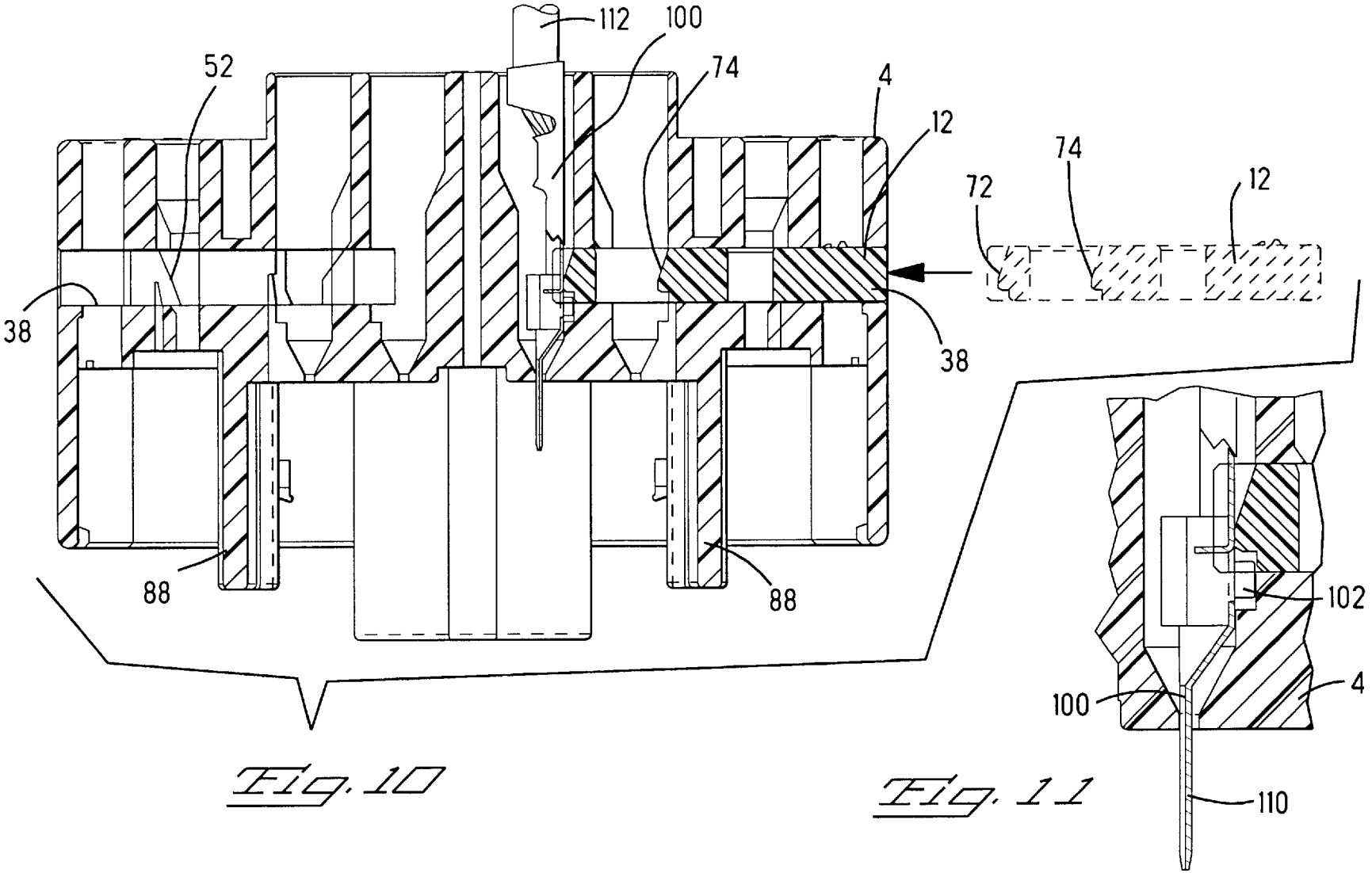
FIG. 10 is a view taken along section lines 10—10 shown in FIG. 6 showing the manner in which the terminal locking plate insures that the terminals cannot be disengaged.
FIG. 11 is an enlarged view of the terminal, the resilient latch and the terminal locking plate shown in FIG. 10.

The movable alignment plate 10 is positioned on the interior surface of the receptacle connector housing 4, and then the terminals are positioned in the connector housings 4, 6, with the locking plates 12 are located in their partially inserted positions,. Tabs on terminals 100 are received within slots on the movable alignment plate 10. The movable alignment plate 10 includes alignment posts 22 located on each of its four corners. These alignment posts 22 are received within grooves 58 located at the four corners of the receptacle connector housing 4 as shown in FIG. 2. A number of beams 24 extend between the posts 22 in the opposite direction. Clearance for these beams 24 is provided by channels 54 located along the sides of the receptacle connector housing 4. The beams 24 located adjacent to the posts 22 at either end of the movable plate 10 include an outwardly directed inclined surface 26 and a latch backup section or backing beam 28 extending from the movable plate 10 on the same side as the posts 22. The latch backup sections or backing beams 28 are spaced from the posts 22. The outermost beams including inclined surfaces 26 also have snap protrusions 60 located on their lower ends as seen in FIG. 3. Snap protrusions 60 are also located on adjacent beams 28 with adjacent snap protrusions being opposed. A protruding retaining boss 62 located on the interior of receptacle housing shroud 44 engages the top of these snap protrusions 60 to hold the movable plate 10 in an extended position to stabilize the ends of the terminals for initial mating. As the plug housing 6 moves closer to the receptacle housing 4, after initial engagement of mating terminals, diamond shaped camming surfaces or protrusions 63, located on the sides of the plug housing 6, engage aligned snap protrusions 60 and force them apart. The snap protrusions 60 are then freed from the retaining bosses and the movable alignment plate 10 shifts upward until it engages the inwardly facing mating surface 42 of the receptacle housing 4. As the plug and receptacle connector halves are mated by the bolt assembly 14, the movable alignment plate 10 moves toward the interior surface 42 of the receptacle connector housing 4. Alignment plate 10 remains parallel to the interior surface 42 of the receptacle connector housing 4 because the posts 22 are stabilized by the grooves 58 in which the posts 22 travel. This rectilinear movement of plate 10 keeps the tabs on male terminals 100 and other terminals in a proper orientation to prevent stubbing with mating terminals during connector mating. Alignment posts 88, shown in FIGS. 7 and 15 extend downward on the lower surface of the receptacle connector housing 4 and through compatible openings in the movable alignment plate 10. As shown in FIG. 15, these alignment posts 88 include a keying extension 90 projecting at an angle from a lower corner of the otherwise I-shaped cross section of the post 88. This cross section permits the posts to fit between closely spaced terminal cavities in this heavily populated connector. The alignment plate 10 is keyed relative to the tower so that it can only be attached to the receptacle connector housing 4 in one orientation. The plug connector housing 6 would also included similarly shaped openings to receive the keyed posts 88 so that the two connector housings 4, 6 and the alignment plate 10 could only be assembled in one orientation.

Figure 4:
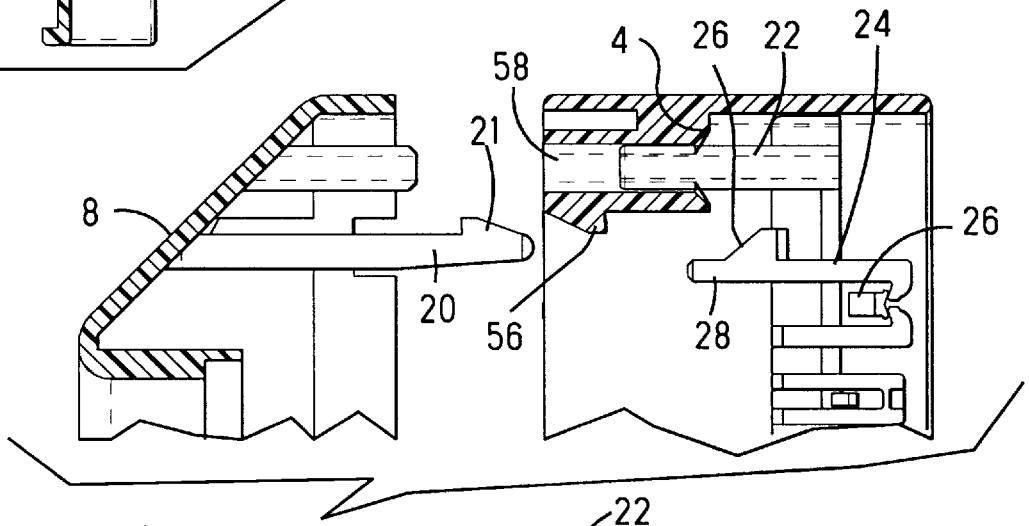
FIG. 4 is a view from the same orientation as FIG. 3 showing the manner in which the movable terminal alignment plate is partially inserted into the receptacle housing member.
Figure 5:
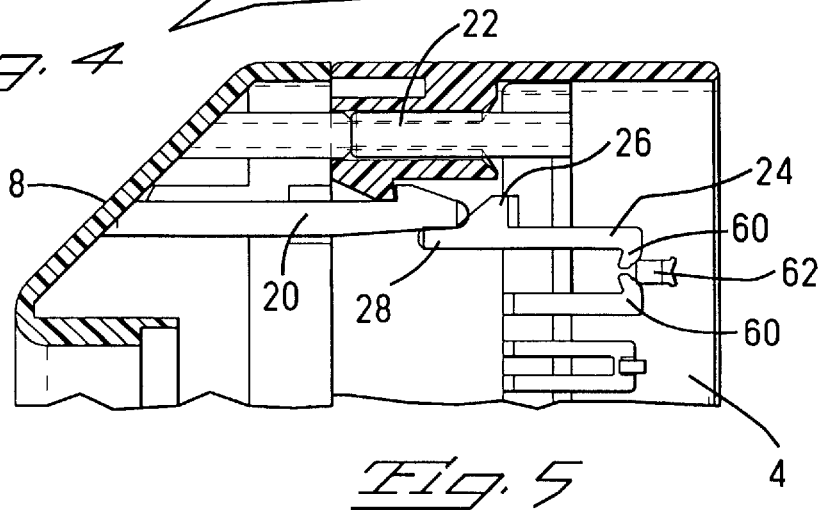
FIG. 5 is a view from the same orientation as FIGS. 3 and 4 showing the connector cover mounted on the receptacle connector with the terminal alignment plate fully inserted and backing up the retention latches on the connector cover.

The connector cover 8 is mounted on the top of the connector assembly, or more precisely over the accessible side of the connector 2. Insulated wires 112 extend up from terminals located in the receptacle connector housing. The wires 112 are routed away from the connector 2 under the cylindrical extension 18 extending from one side of the connector cover. Cover 8 includes resilient cover latches 20 extending downward adjacent to the four corners of the cover. These molded resilient latches 20 are tapered from the root toward the latch ends so that the cantilever latches are both flexible and have sufficient strength to prevent breakage. Each latch 20 includes a conventional snap lock 21 on the end. These snap locks have downwardly facing inclined camming surfaces and upwardly facing locking surface so that the latch is cammed outwardly over a protrusion during movement from the position shown in FIG. 4 to the position shown in FIG. 5 where the latch snaps back to its neutral locking position. As shown in FIG. 5, the snap lock 21 engages an opposed locking surface or shoulder 56 along the side of the receptacle connector housing 4. Although this snap lock engagement is sufficient to secure the cover 8 to the receptacle connector housing 4 under typical conditions, sufficient force can be applied to the cover to overcome this conventional latching engagement. Especially in automotive applications, this force can be transmitted to the cover 8 when the wires leading from extension 18 are pulled or moved. Disengagement of the cover 8 in this manner is undesirable. To restrain or reinforce the latch 20 and to prevent the snap lock 21 from being disengaged from the locking shoulder 56, the adjacent side beam 24 extends above the base of the movable plate 10 to form a support or backing beam 28 for the latch 20. Support 28 in the form of an upwardly extending beam includes an inclined surface 26 at its lower end and the end of support beam 28 is positioned and configured to engage the back surface of the latch 20 behind the snap latch 21. Snap latch 21 is thus assured of its position with respect to the shoulder 56 and the latch cannot become disengaged by forces applied to the wire 112 or to the cover 8. As previously discussed, the movable plate 10 is not moved upward until the last part of the connector mating operation because the engagement of snap tabs 60 by protruding bosses 62. Therefore the support beam extensions 28 are not moved into position adjacent to the back of latches 20 until the latter stages of the mating engagement. Cover 8 must therefore be attached to the receptacle connector housing 4 prior to the time that the two connector halves are mated. Cover 8 could be attached before the receptacle connector housing 4 is aligned with plug connector housing 6. Alternatively, the cover 8 can be attached after the two connector halves are attached and aligned and before mating. In either case, protruding nubs on the cover engage the housing to prevent rotation or cocking of the cover relative to the connector housing so that the latches are not overstressed.

The manner in which the terminals 100 are held in the receptacle connector housing 4 is shown in more detail in FIGS. 6–14. Although only the larger terminals 100 and the receptacle connector housing 4 are shown and discussed in detail, it should be understood that the manner in which these terminals are retained in this housing is representative of the terminal retention in the plug connector housing 6 and the terminal retention for the signal terminals in terminal cavities 36. The stamped and formed blade terminals 100 are inserted into terminal cavities 36 in the receptacle housing 4. Mating stamped and formed socket terminals, not shown, are inserted into companion terminals cavities in the plug connector housing 6. Both the blade terminals 100 and the mating socket terminals are of conventional constructions and can be stamped from a conventional material, such as phosbronze, and are plated in a conventional manner. These terminals are generally referred to as crimp snap terminals.

Terminal 100 has a mating blade 110 at one end of the terminal and a crimp barrel 108 at the opposite end. The crimp barrel 108 is crimped or formed around an uninsulated end of a wire 112 to form a permanent electrical connection. This termination can be performed on a number of high speed machines. Each terminal 100 also includes latching surfaces between the crimp barrel 108 and the blade 110. The primary latching surface is an opening 104 that is configured to receive a molded resilient latch 50 protruding into the corresponding terminals cavity 34 from one end. The molded latch is cammed outwardly upon insertion of the terminal 100 and then returns to its neutral position when the terminal 100 is located so that the latch 50 can enter the terminal opening 104. Each terminal 100 also includes a latching tab 102 that protrudes outwardly beside the opening 104. This latching tab 102 is positioned for engagement with a surface on the secondary locking plate 12 that is inserted into its final position after the terminals 100 and signal terminals have been seated in engagement by the corresponding resilient latch.

One of the secondary locking plates 12 is best seen in FIG. 6. Locking plates 12 are flat molded members that can be inserted into slots 38 that open on both ends 46 of the receptacle connector housing 4. Similar locking plate slots open on the ends of the plug connector housing 6. The locking plate slots 70 intersect the terminal cavities 34 in the connector housing 4. Each locking plate 12 has a central section 66 with two cantilever arms 68 located on the ends of the plate 12. The arms 68 are separated from the central section 66 by recesses or slots 70. Recesses or slots 70 in turn have inset openings 80 that extend from each side of the corresponding slot 70 to provide clearance for a terminal 100 to pass through the clearance opening 80 when the clearance opening is positioned in alignment with a corresponding terminal cavity 34. A number of signal terminal openings 82 are located in the central plate section 66. These signal terminal openings are in turn large enough to permit insertion of a signal terminal when the signal terminal opening 82 is properly positioned relative to a corresponding signal terminal opening 36.

A series of locking tabs 72, 74, 76 are formed along the arms 68 and on the edges of the central section 66 in the terminal openings through which terminals 100 are to be inserted. Each of these locking tabs has a thickness that is less than the thickness of the remainder of the locking plate 12 and has a tapered cross section. Locking tabs 72 extend from the ends of the arms 68 while the locking tabs 74 and 76 extend into the respective clearance openings 80. Each of the signal terminal clearance openings 82 also includes a similar locking tab 78 extending inwardly form one edge. Each of the locking tabs 74, 76 and 78 extend from the clearance edge opening adjacent to the base of the locking plate 12 toward the free end of the locking plate 12 and the cantilever arms 68. Despite the presence of the various locking tabs, the respective clearance openings are still large enough to permit insertion of the corresponding terminal into the respective terminal cavity and through the clearance opening when the locking plate 12 is in the partially inserted position. The locking plate 12 also has resilient fingers 92 located along the base. These resilient fingers 92 engage opposed surfaces at the top of the locking plate slot 38 to hold the locking plate 12 initially in the partially inserted position where the clearance openings are aligned with corresponding terminal cavities to permit insertion of the terminals into the slots and a final position, shown in FIG. 9, in which the locking tabs engage terminal latching tabs 102 to provide a secondary or redundant lock holding the terminals in their respective housings.

The locking tabs 72, 74, 76, and 78 are brought into engagement with latching tabs on respective terminals, such as latching tab 102 on the larger power terminals 100, by pushing the locking plates 12 further into the locking plate slots 38. When the locking plates 12 are full inserted, the locking tabs extend into the terminal cavities and are positioned over surfaces on the terminal, such as latching tab 102 on terminals 100. The terminals cannot then be pulled out of their respective terminal cavities because that would require not only destruction of the molded resilient terminal latches 50 and 52, but also the locking tabs 72, 74, 76 and 78.

Figure 14:
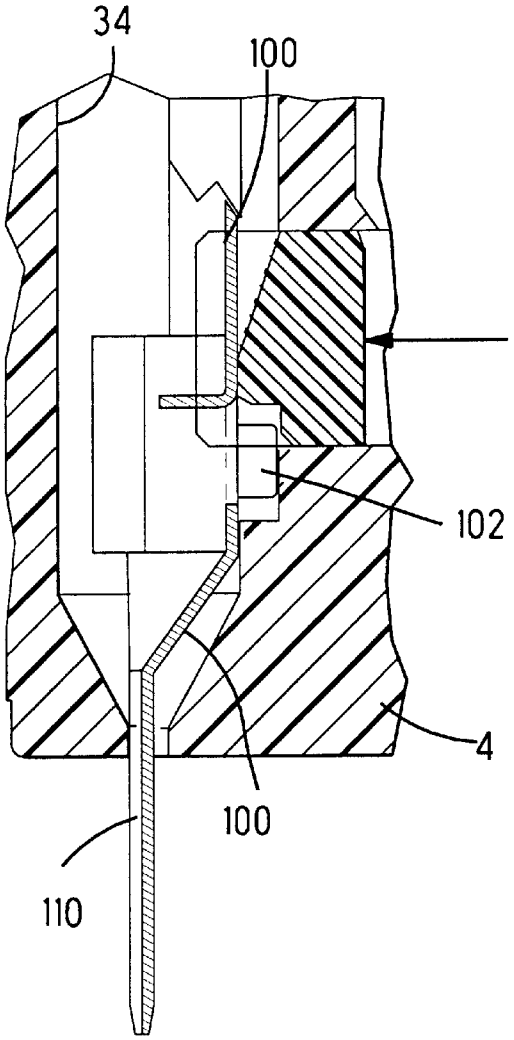
FIGS. 13 and 14 are sectional views taken in planes parallel to the section shown in FIG. 12 showing the insertion of the terminal locking plate and showing the latching surfaces located on opposite sides of the resilient latch shown in FIG. 12.
Figure 13:
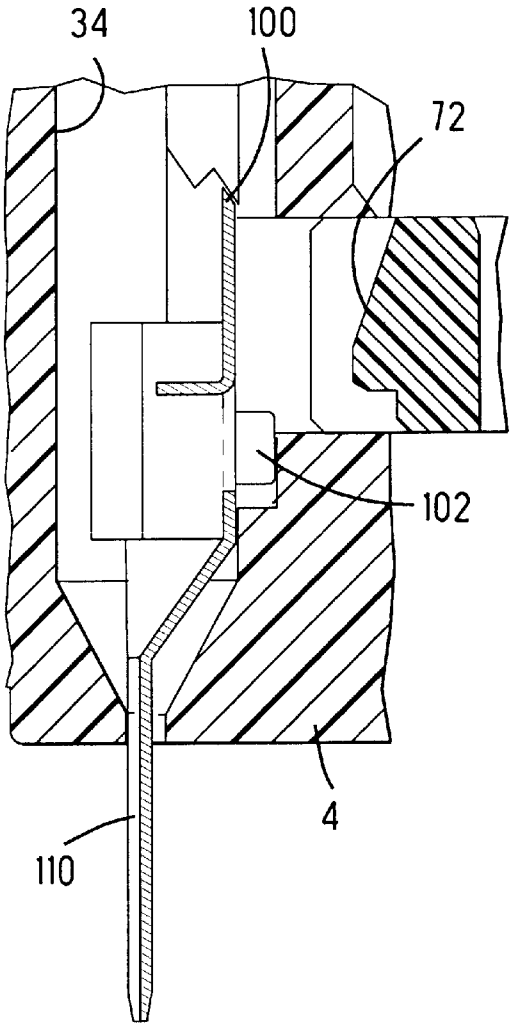
Figure 12:
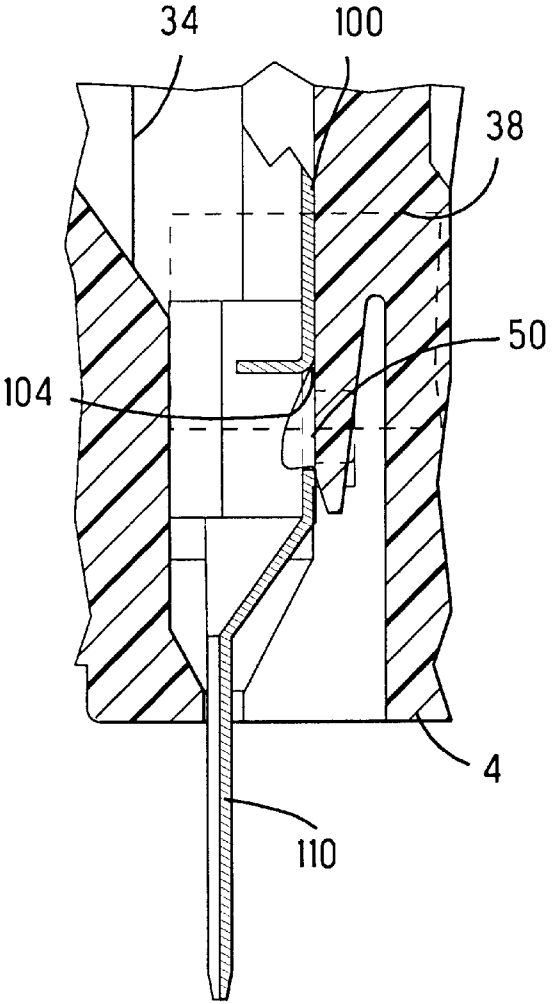
FIG. 12 is a side section view showing the engagement of the resilient latch with a terminal.

FIGS. 12, 13, and 14 show the relative position of a terminal 100, a resilient latch 50, a locking plate 12 and a locking tab 72 on the end of arm 68. The section shown in FIG. 12 is taken through the resilient latch 50 and the terminal latch opening 102 in which it fits. The latching slot 38 is shown in phantom. FIG. 13 shows a section that is parallel to the section shown in FIG. 12. This section extends through the locking tab 72 on the front of the locking plate 12. The section shown in FIG. 13 is offset from the resilient latch 50 shown in FIG. 12 and this resilient latch will fit in the recess or slot extending between the cantilever arm 68 and the central section 66 on the locking plate 12. The tapered shape of the locking tab 72, and of the other tabs 74, 76 and 78 on the locking plate 12 is shown in FIGS. 13 and 14. The locking plate 12 and the locking tab 72 on the front of the cantilever arm 68 is shown in the partially inserted position in FIG. 13, and the terminal cavity is not obstructed by the locking tab 72. FIG. 14 shows the same section view as in FIG. 13, but the locking plate 12 has now been moved to the fully inserted position shown in FIG. 9. The tapered locking tab 72 is positioned above the terminal tab 102 in FIG. 14. In this position the locking tab 72 provides a secondary or redundant lock for the terminal 100.

FIGS. 7, 8 and 12 show the profile of the resilient latches 50 and their position relative to the locking plate slot 38. Each of these resilient latches used to restrain one of the larger terminals, such as terminal 100, extends at least partially through the locking plate slot 38. These cantilever latches 50 extend from a post, of rectangular cross section, that extends between portions of the housing on opposite sides of the slot 38. As seen in FIG. 7 the molded resilient latches are flexible cantilever beams with the root section located within the locking plate slot 38. The free end of each molded resilient latch 50 is located below the locking plate slot 38. As also seen in FIG. 7, the length of the molded resilient latches 50, positioned toward the middle of the connector, is less than the length of the outermost resilient latches 50. Latch 50 extends to the top of the locking plate slot 38. The width of each of the molded resilient latches 50 is less than the width of the recess or slots 70 separating the arms 68 on the locking plate 12 from the central locking plate section 66. Therefore these molded resilient latches 50 on the receptacle housing 4 fit within the recesses 70 when the locking plate 12 is moved into position. This configuration can be seen by comparing FIG. 12 with FIGS. 13 and 14 which show that the locking tabs 72 engage the terminal tabs 102 beside the engagement of the molded resilient latch 50 with terminal opening 104. The same relationship applies to locking tabs 74, 76 and the other molded resilient latches 50 This relationship is also found in the mating socket terminals, locking plates and molded resilient latches employed in the mating plug connector housing 6.

I claim:

1. An electrical connector comprising:

a connector housing including terminal cavities in which terminal are positioned, a molded resilient terminal latch extending into at least one terminal cavity to engage a terminal positioned therein;

a locking plate slot extending from one end of the connector housing and communicating with the terminal cavity containing the molded resilient terminal latch, the molded resilient terminal latch extending through at least part of the locking plate slot;

a locking plate insertable into the locking plate slot and including a locking surface for providing additional retention of the terminal in the terminal cavity when the locking plate is fully inserted into the locking plate slot, the locking plate including a recess aligned with the molded resilient terminal latch so that the molded resilient terminal latch is received within the latching plate recess when the locking plate if fully inserted into the locking plate slot.

2. The electrical connector of claim 1 wherein the locking surface on the locking plate and the molded resilient terminal latch on the connector housing separately engage the terminal in the terminal cavity.

3. The electrical connector of claim 2 wherein the locking plate does not engage the molded resilient terminal latch when the locking surface on the locking plate is in engagement with the terminal.

4. The electrical connector of claim 3 wherein the locking surface on the locking plate engages the terminal beside the molded resilient terminal latch.

5. The electrical connector of claim 1 wherein plural aligned molded resilient terminal latches extending into plural aligned terminal cavities are received within the recess in the locking plate when the locking plate is fully inserted into the locking plate slot.

6. The electrical connector of claim 1 wherein the locking plate recess includes a clearance opening aligned with the terminal cavity when the locking plate is in a partially inserted position to allow a terminal to be inserted into a terminal cavity and into engagement with the molded resilient terminal latch, the locking surface on the locking plate engaging the terminal only after the locking plate is fully inserted into the locking plate slot.

7. The electrical connector of claim 1 including locking plates insertable into opposite ends of the connector housing.

8. The electrical connector of claim 7 wherein the molded resilient terminal latch faces the center of the housing.

* * * * *